US012460368B2

(12) United States Patent
Kundel, Sr.

(10) Patent No.: US 12,460,368 B2
(45) Date of Patent: Nov. 4, 2025

(54) END CAP ASSEMBLY FOR A TRENCH BOX AND METHOD OF UTILIZATION THEREOF

(71) Applicant: Kundel Industries, Inc., Vienna, OH (US)

(72) Inventor: Robert Kundel, Sr., Cortland, OH (US)

(73) Assignee: Kundel Industries, Inc., Vienna, OH (US)

( * ) Notice: Subject to any disclaimer, the term of this patent is extended or adjusted under 35 U.S.C. 154(b) by 110 days.

(21) Appl. No.: 18/538,075

(22) Filed: Dec. 13, 2023

(65) Prior Publication Data

US 2025/0198109 A1 Jun. 19, 2025

(51) Int. Cl.
*E02D 17/08* (2006.01)

(52) U.S. Cl.
CPC ..... *E02D 17/086* (2013.01); *E02D 17/08* (2013.01)

(58) Field of Classification Search
CPC ..... E02D 17/06; E02D 17/083; E02D 17/086
USPC ..... 405/272, 282, 283
See application file for complete search history.

(56) References Cited

U.S. PATENT DOCUMENTS

| | | | | |
|---|---|---|---|---|
| 3,089,310 | A | 5/1963 | Torti | |
| 3,922,866 | A | 12/1975 | Benning | |
| 4,202,649 | A | 5/1980 | Cook | |
| 4,659,260 | A | 4/1987 | Morelli | |
| 11,624,167 | B2 | 4/2023 | Strom | |
| 2020/0217035 | A1* | 7/2020 | Cerda | E02D 17/08 |
| 2022/0090354 | A1 | 3/2022 | Dewind | |

FOREIGN PATENT DOCUMENTS

| | | | |
|---|---|---|---|
| DE | 102015017177 | A1 | 4/2017 |
| DE | 102019117190 | A1 | 12/2020 |
| GB | 532849 | A | 1/1941 |
| GB | 1249914 | A | 10/1971 |
| KR | 102424715 | B1 | 7/2022 |

OTHER PUBLICATIONS

End Closure Panel, available, [site visited Oct. 4, 2023], Available from Internet, <URL: https://www.mabeyhire.co.uk/engineered-solutions/our-products/groundworks/trench-boxes/end-closure-panel.

https://gme-shields.com/wp-content/uploads/2017/06/2017-Steel-Products.pdf—GME Trench Protection Specialist Brochure—p. 14—date printed: Oct. 2, 2023.

* cited by examiner

*Primary Examiner* — Sunil Singh
(74) *Attorney, Agent, or Firm* — Sand, Sebolt & Wernow Co., LPA

(57) ABSTRACT

A trench box assembly including a trench box and an end cap assembly extending outwardly beyond an end of the trench box. The trench box has two metal plates and spreader bars extending between the plates. The end cap assembly includes a housing and an attachment mechanism. The housing has a first side wall, a second side wall, a top wall, and a back wall which bound and define an interior chamber of a size suitable to receive at least part of a worker's body therein. The attachment mechanism includes attachment hooks which adjustably engage the housing to the spreader bars. When the trench box assembly is installed within a trench the end cap assembly protects a worker performing a task proximate one end of the trench box from being injured by debris falling into a region of the trench adjacent the end of the trench box.

17 Claims, 10 Drawing Sheets

END CAP ASSEMBLY FOR A TRENCH BOX AND METHOD OF UTILIZATION THEREOF

TECHNICAL FIELD

This disclosure is directed to equipment used during excavation operations. More particularly, the disclosure is directed to trench boxes which are installed in trenches during excavation operations. Specifically, the disclosure relates to a trench box end cap assembly which is installed on spreader bars at one end of the trench box and extends outwardly beyond the end of the trench box to protect a worker who is working at one end of the trench.

BACKGROUND ART

In order to construct buildings and install utilities it is frequently necessary to excavate earth at a job site. The excavation may be accomplished by using a wide range of digging tools from shovels to backhoes and through to large excavators which remove rocks and soil from particular areas and deposit them elsewhere. In order to lay utilities or repair utilities it may be necessary to dig a trench, i.e., a hole that is usually deeper than it is wide. If the trench is dug to a depth of four or more feet, then workers entering the trench are at risk of the sides of the trench suddenly collapsing in on them and burying them.

In order to mitigate this risk, it is common for a trench box to be installed in trenches of a certain depth during excavation. In some jurisdictions for example, a trench of five feet or more in depth must have a trench box installed as the trench is excavated. A trench box essentially comprises two or more large metal plates arranged parallel to one another, and separated from one another by spreader bars. Trench boxes are large and heavy and therefore have to be assembled, manipulated, installed, and removed by mechanized lifting equipment. An initial hole is dug by the digging equipment and then the trench box is installed in such a way that the metal plates are located adjacent to the sides of the trench and the spreader bars extend between the metal plates. The spreader bars hold the metal plates a set distance apart from one another. The scoop of the digging equipment is inserted between the two plates and is used to continue to remove rocks and soil in order to extend the length and/or depth of the trench. The trench box is periodically tamped down using the digging equipment and digging is continued until the desired length and depth of the trench is reached. In some instances, additional trench boxes are installed one or both of on top of the first trench box or extend outwardly beyond one end of the first trench box. In some instances, a metal end plate is oriented at right angles to the two metal side plate and is installed between the side plates at an end of the trench box. In other instances, the ends of the trench box are left open and are not covered by an end plate. Once the desired depth and length of trench is dug, soil is backfilled between the sides of the trench and the exterior surfaces of the two metal side plates. The workers can then safely enter into a space defined between the interior surfaces of the metal side plates of the trench box and safely perform their required work.

One of the issues that is encountered while workers are working within the space defined by the trench box is that open ends of the trench box may allow loose rocks and/or soil to fall into that part of the space proximate the open end of the trench box. Consequently, workers may remain at risk of becoming injured or trapped within the end regions of the trench box.

SUMMARY OF THE INVENTION

In one aspect, an exemplary embodiment of the present disclosure may provide an end cap assembly to a trench box to protect a worker from falling debris, said end cap assembly comprising a housing of a size suitable to receive a part of the worker's body therein; an attachment mechanism operably engaged with the housing; and wherein the attachment mechanism is configured to detachably engage the housing to at least one of a plurality of spreader bars of a trench box.

In one embodiment, the housing may comprise a first side wall and a second side wall located opposite one another; a top wall extending between a top end of the first side wall and a top end of the second side wall; a back wall extending downwardly from the top wall and extending between the first side wall and second side wall; and wherein the first side wall, the second side wall, the top wall, and the back wall bound and define an interior chamber which is sized to receive the part of the worker's body therein. In one embodiment, the end cap assembly may further comprise a first opening to the interior chamber defined between a first end of the first side wall and a first end of the second side wall. In one embodiment, the end cap assembly may further comprise a second opening to the interior chamber defined between a bottom end of the first side wall and a bottom end of the second side wall. In one embodiment, the top wall of the housing may slope downwardly and rearwardly towards a top end of the back wall. In one embodiment, the top wall may be convex in shape. In one embodiment, the attachment mechanism may comprise an attachment hook extending outwardly from the housing; wherein the attachment hook is configured to detachably engage the at least one of the plurality of spreader bars of the trench box. In one embodiment, the attachment hook may be adjustably engaged with the housing. In one embodiment, the attachment mechanism may further comprise a channel defined in the housing; and a fastener extending through a portion of the attachment hook and into the channel; wherein the fastener is selectively movable along the channel to adjust a position of the attachment hook relative to the housing.

In another aspect, an exemplary embodiment of the present disclosure may provide a trench box assembly for protecting a worker from falling debris, said trench box assembly comprising a trench box having a first end and a second end, said trench box comprising a first metal plate and a second metal plate arranged parallel to one another and laterally spaced apart from one another; a plurality of spreaders bars extending between the first metal plate and the second metal plate; and an end cap assembly detachably operatively engaged with the plurality of spreader bars of the trench box such that the end cap assembly extends outwardly beyond the first end of the trench box.

In one embodiment, the end cap assembly may include a top wall and wherein the top wall is configured to prevent debris from falling onto a worker working below the top wall. In one embodiment, the end cap assembly may comprise a housing defining an interior chamber of a size suitable to receive at least part of the worker's body therein; an attachment mechanism operably engaged with the housing; wherein the attachment mechanism is configured to detachably engage the end cap assembly with the at least one of the plurality of spreader bars of the trench box. In one embodiment, the housing may comprise a first side wall and a second side wall located opposite one another; a top wall extending between a top end of the first side wall and a top end of the second side wall; a back wall extending downwardly from the top wall and extending between the first side wall and second side wall; and wherein the first side wall, the second side wall, the top wall, and the back wall bound and define an interior chamber which is sized to receive the part of the worker's body therein. In one embodiment, the attachment mechanism may comprise an attachment hook extending outwardly from the housing; and wherein the attachment hook is configured to detachably engage the at least one of the plurality of spreader bars of the trench box. In one embodiment, the attachment hook may be adjustably engaged with the housing. In one embodiment, the attachment mechanism may further comprise a channel defined in the housing; and a fastener extending through a portion of the attachment hook and into the channel; wherein the fastener is selectively movable along the channel to adjust a position of the attachment hook relative to the housing.

In another aspect, and exemplary embodiment of the present disclosure may provide a method of protecting a worker in a trench from falling debris, wherein the method comprises digging the trench to perform a work operation therein; providing a trench box including a first metal plate and a second metal plate arranged parallel to and laterally spaced apart from one another; providing a plurality of spreader bars extending laterally between the first metal plate and the second metal plate; engaging an end cap assembly with the trench box such that the end cap assembly projects outwardly beyond a first end of the trench box; installing the trench box within the trench; and protecting the worker within the end cap assembly when the worker enters an area of the trench below the end cap assembly.

In one embodiment, the method may further comprise providing a sloped top wall on the end cap assembly; angling the sloped top wall downwardly away from the plurality of spreader bars and the first end of the trench box; and causing debris falling on the sloped top wall to slide off the sloped top wall in a direction moving away from a safe space defined between the first metal plate and the second metal plate of the trench box. In one embodiment, the method may further comprise defining an interior chamber in a housing of the end cap assembly; and allowing a worker to at least partially enter the interior chamber; and preventing debris falling onto the housing from contacting the worker. In one embodiment, providing the plurality of spreader bars may include providing a first set of spreader bars extending laterally between the first metal plate and the second metal plate proximate the first end of the trench box, and providing a second set of spreader bars extending laterally between the first metal plate and the second metal plate proximate a second end of the trench box; and wherein the method further comprises engaging the end cap assembly with the first set of spreader bars such that the end cap assembly projects outwardly beyond the first end of the trench box; and engaging a second end cap assembly with the second set of spreader bars such that the second end cap assembly projects outwardly beyond the second end of the trench box.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
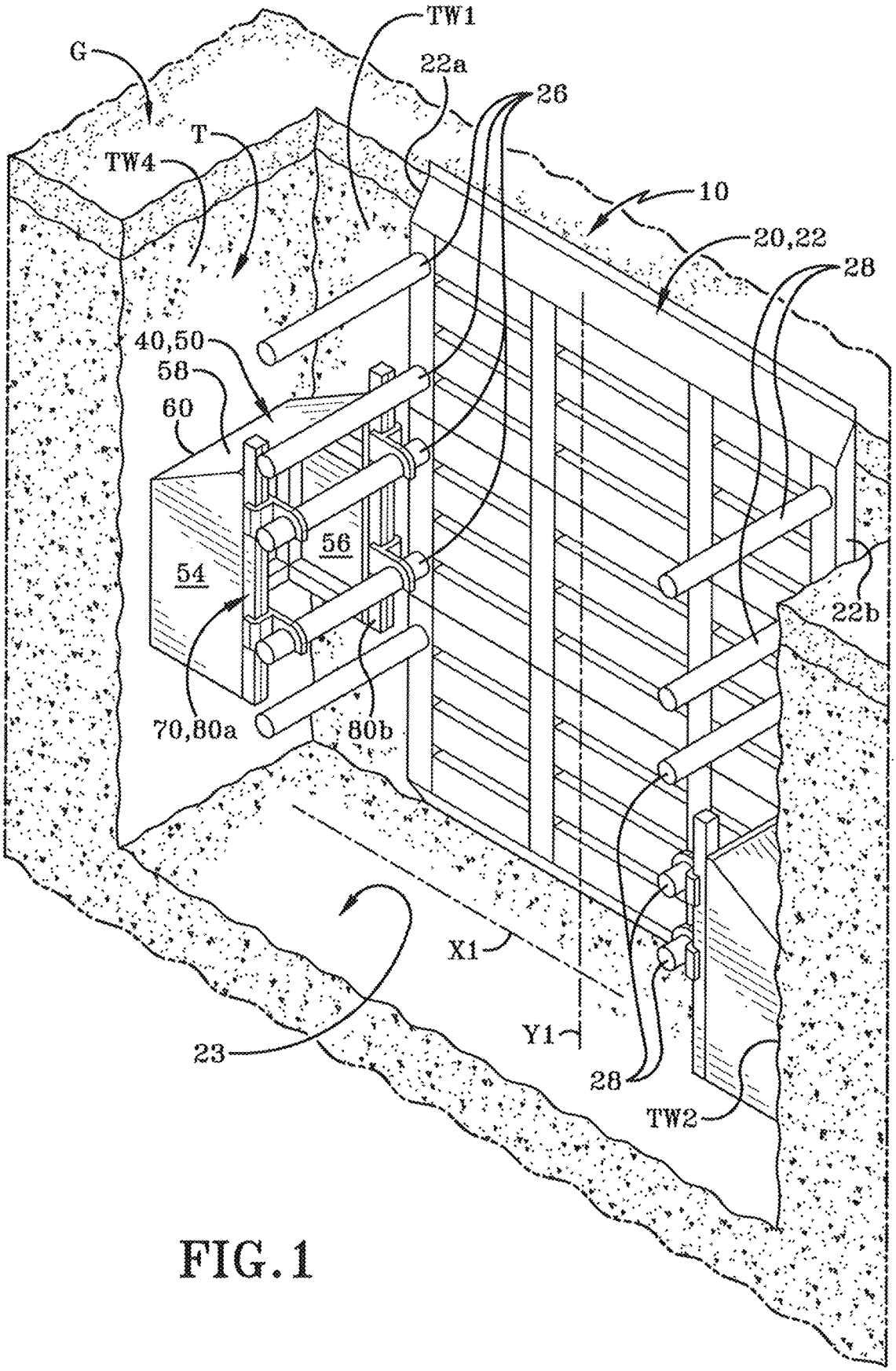
FIG. 1 (FIG. 1) is partial top, front, left side isometric perspective view of a trench box assembly in accordance with the present disclosure partially installed within a trench, with some of the ground around the trench box assembly and a portion of the trench box assembly removed for clarity of illustration.
Figure 2:
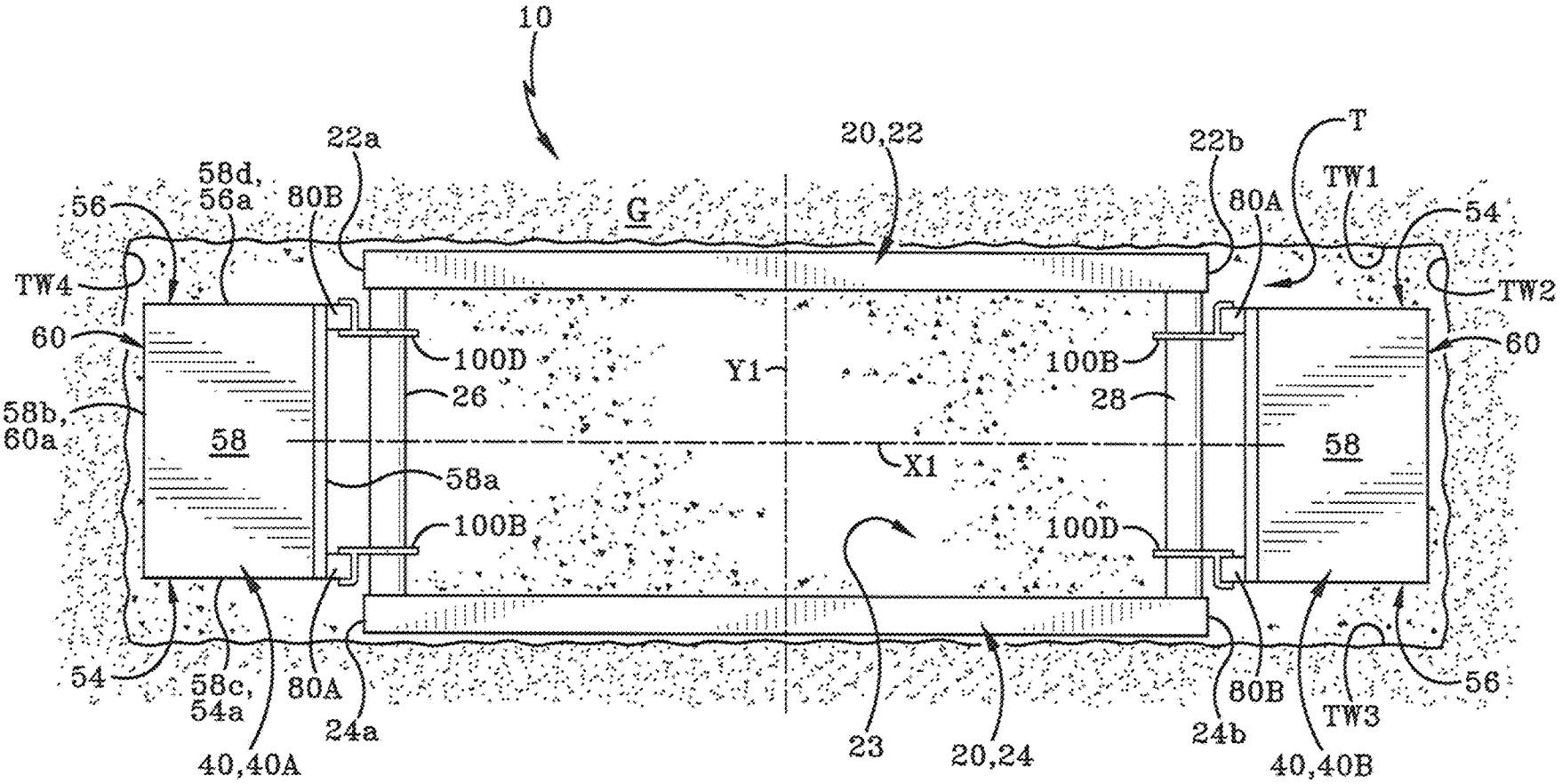
FIG. 2 (FIG. 2) is a top plan view of the trench box in accordance with the present disclosure shown fully installed within the trench.

Referring to FIGS. 1 and 2, there is shown a trench box assembly in accordance with the present disclosure, generally indicated at 10. Trench box assembly 10 generally includes a trench box 20 and an end cap assembly 40. Trench box assembly 10 is installed in a trench "T" dug in the earth, where the trench "T" is bounded and defined by a first trench wall "TW1", a second trench wall "TW2", a third trench wall "TW3" and a fourth trench wall "TW4."

Trench box 20 comprises a first metal plate 22, a second metal plate 24, and a plurality of spreader bars 26, 28. During installation within trench "T", first metal plate 22 is positioned adjacent to the first trench wall "TW1" and the second metal plate 24 is positioned adjacent to the third trench wall "TW3". In one specific embodiment, trench box 20 may comprise a first set of spreader bars 26 and a second plurality of spreader bars 28. The first metal plate 22 and the second metal plate 24 are installed within trench "T" parallel to one another and parallel to a longitudinal axis "X1". First metal plate 22 and second metal plate 24 are spaced a lateral distance apart from one another The first set of spreader bars 26 and the second set of spreader bars 28 are installed between first metal plate 22 and second metal plate so as to be parallel to one another and parallel to axis "Y1". First set of spreader bars 26 and second set of spreader bars are spaced a distance longitudinally apart from one other. The first set of spreader bars 26 is integrally engaged with the first metal plate 22 and the second metal plate 24 and extends between a first end region 22*a* of the first metal plate 22 and a first end 24*a* of the second metal plate 24. The second set of spreader bars 28 is integrally engaged with the first metal plate 22 and the second metal plate 24 and extends between a second end region 22*b* of the first metal plate 22 and a second end 24*b* of the second metal plate 24. A safe workspace 23 (FIG. 2) for a worker is defined between an interior surface of first metal plate 22 and an interior surface of second metal plate 24.

Figure 3:
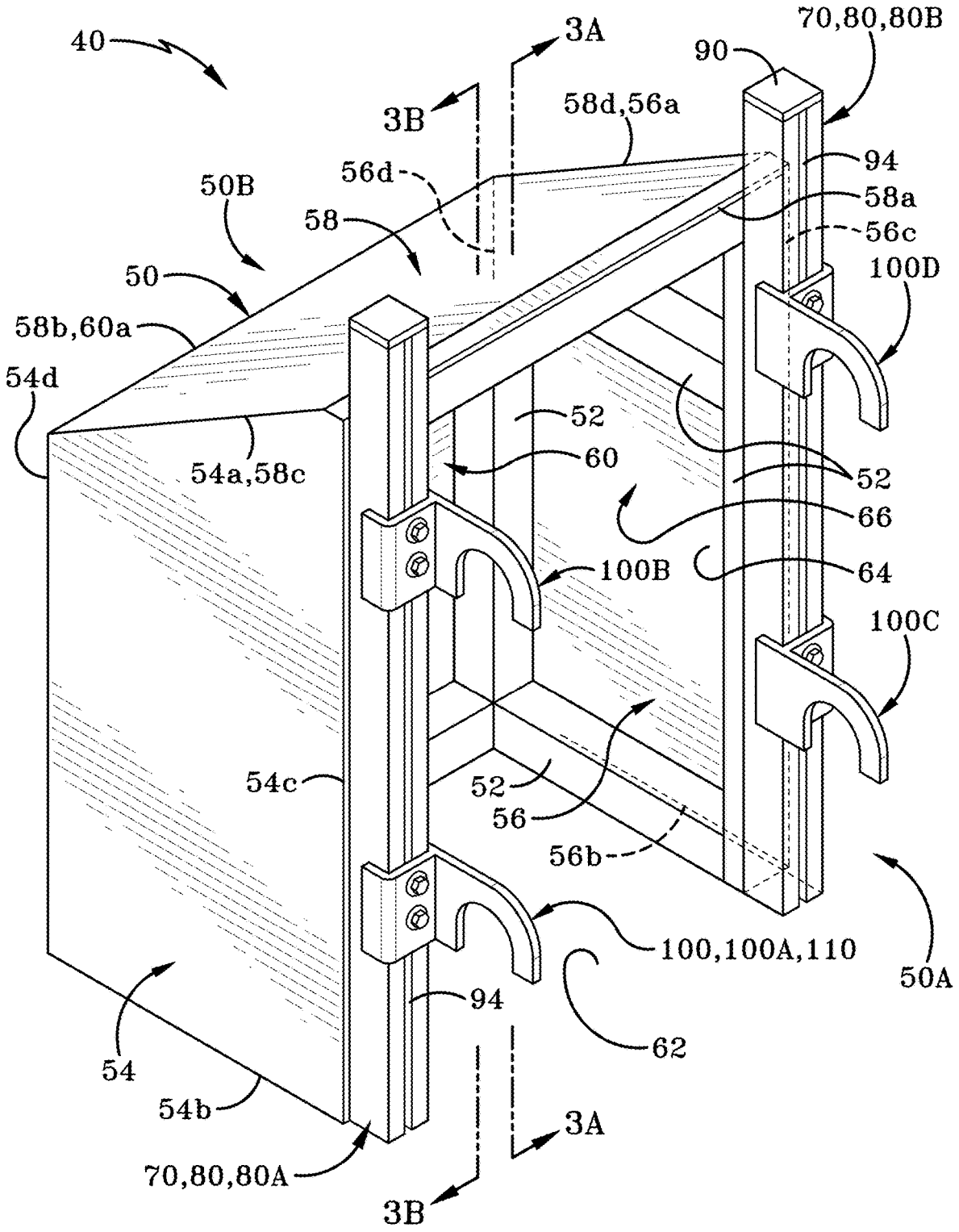
FIG. 3 (FIG. 3) is a top, front, left side isometric perspective view of an end cap assembly of the trench box assembly of FIG. 1, wherein the end cap assembly is shown in isolation.

Referring to FIGS. 1-3, in accordance with an aspect of the present disclosure, the trench box assembly 10 further comprises at least one end cap assembly 40 operatively engaged with trench box 20. End cap assembly 40 may be operatively engaged with and extend outwardly from either of the first end region 22*a*, 24*a* or the second end region 22*b*, 24*b* of trench box 20. End cap assembly 40 will be described in greater detail hereafter. FIGS. 1 and 2 show that the trench box assembly 10 includes a first end cap assembly 40A operatively engaged with and extending outwardly from the first end region 22*a*, 24*a* of trench box 20 and a second end cap assembly 40B operatively engaged with and extending outwardly from the second end region 22*b*, 24*b* of trench box 20. (It will be understood that in other embodiments only a single end cap assembly 40 may be engaged with trench box 20.) The end cap 40, first end cap assembly 40A (FIGS. 1 and 2), and second end cap assembly 40B are identical in all respects to structure and function. It should be therefore understood that the following description of the end cap assembly 40 applies equally to the first end cap assembly 40A and the second end cap assembly 40B illustrated in FIGS. 1 and 2.

Figure 3B:
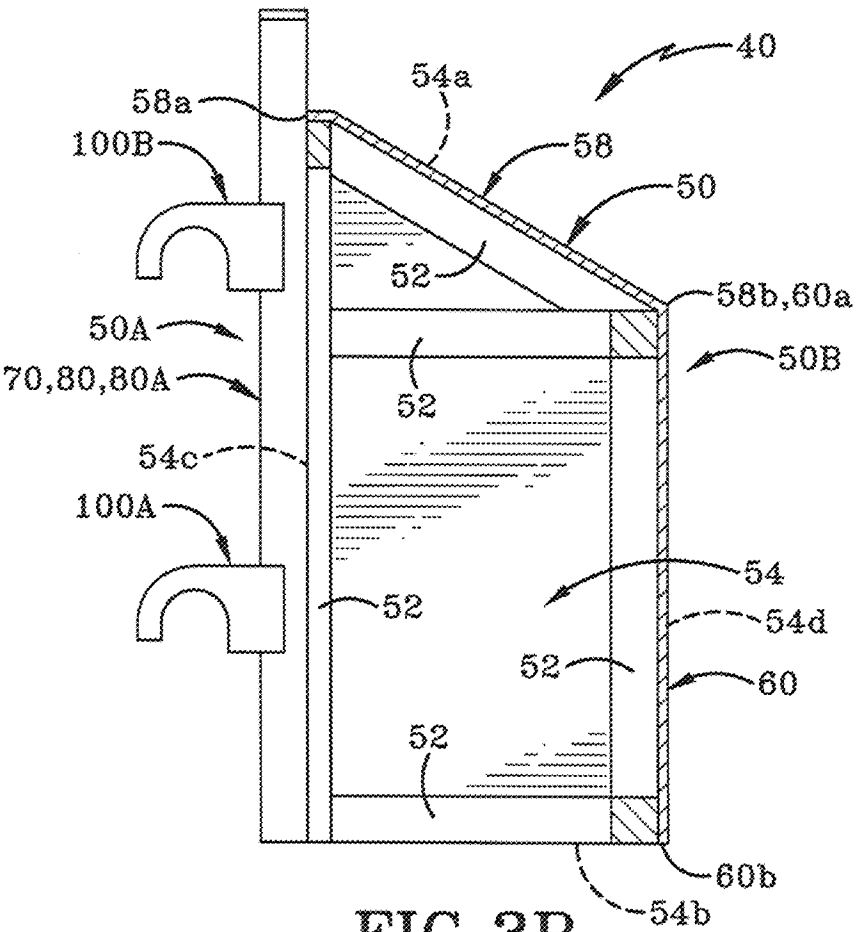
FIG. 3B (FIG. 3B) is a cross-section of the end cap assembly taken along and looking in the direction of line 3B-3B of FIG. 3.
Figure 3A:
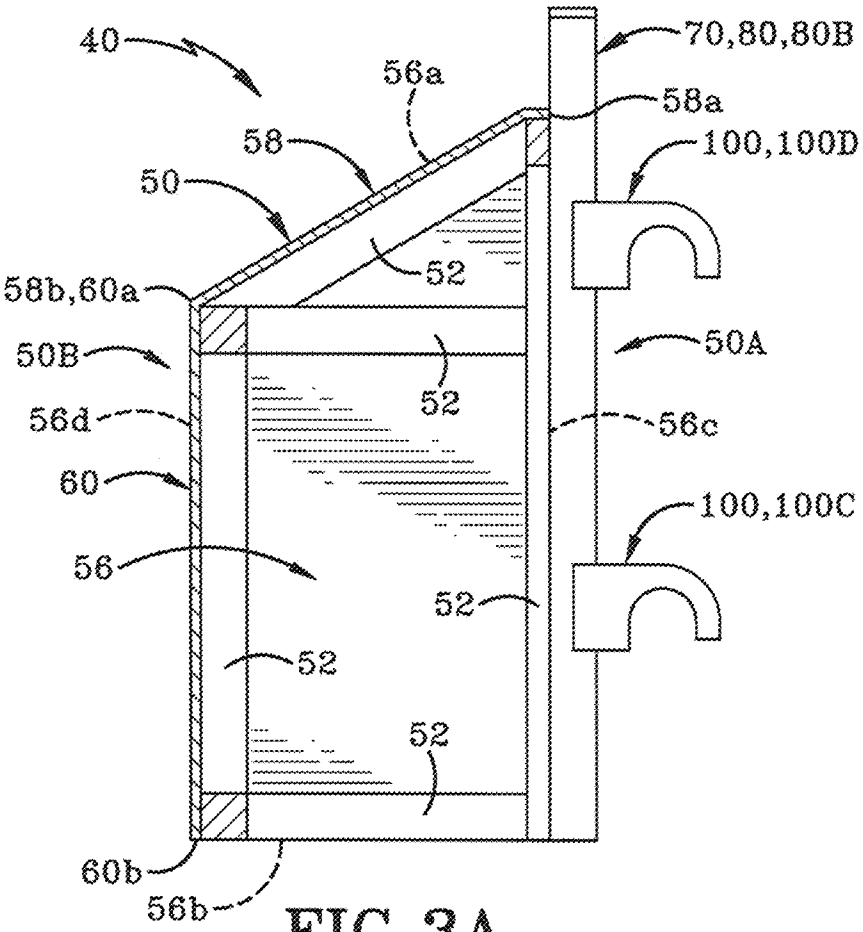
FIG. 3A (FIG. 3A) is a cross-section of the end cap assembly taken along and looking in the direction of line 3A-3A of FIG. 3.

End cap assembly 40 includes a housing 50 and an attachment mechanism 70. Housing 50 comprises a frame 52, a first side wall 54, a second side wall 56, a top wall 58, and a back wall 60. The frame 52 may have any number of frame members arranged to adequately support metal plates which make up first side wall 54, second side wall 56, top wall 58, and back wall 60. Referring to FIGS. 3, 3A and 3B, first side wall 54, second side wall 56, top wall 58, and back wall 60 are secured to frame 52 and to one another in any suitable manner such as by welding the components to one another to form an integral structure or by utilizing any suitable type of fastener such as nuts and bolts.

First side wall 54 has a top end 54*a*, a bottom end 54*b*, a first end 54*c*, and a second end 54*d*. Second side wall 56 has a top end 56*a*, a bottom end 56*b*, a first end 56*c*, and a second end 56*d*. Each of the first side wall 54 and second side wall 56 is trapezoidal in shape with first end 54*c*, 56*c* and second end 54*d*, 56*d* being arranged parallel to one another and bottom end 54*b*, 56*b* arranged at ninety degrees to first end 54*c*, 56*c* and second ends 54*d*, 56*d*. As best seen in FIG. 3, first ends 54*c*, 56*c* are of a greater length than the associated second end (such as second end 54*d*) of first side wall 54 and second side wall 56. Top wall 58 has a first end 58*a*, a second end 58*b*, a first side 58*c*, and a second side 58*d*. Back wall 60 has a top end 60*a* (FIG. 7) and a bottom end 60*b* extending between a first side and a second side. The first side and second side of back wall 60 are not numbered herein.

First side wall 54 and second side wall 56 are arranged parallel to one another and disposed opposite each other about frame 52 of housing 50. First side wall 54 and second side wall 56 are spaced a distance laterally apart from one another other along axis "Y2". Top wall 58 and back wall 60 extend between first side wall 54 and second side wall 56. First end 58*a* of top wall 58 is aligned with first end 54*c* of first side wall 54 and first end 56*c* of second side wall 56. Second end 58*b* of top wall 58 is aligned with second end 54*d* of first side wall 54 and the second end of second side wall 56. First side 58*c* of top wall 58 abuts top end 54*a* of first side wall 54 and second side 58*d* of top wall 68 abuts top end 56*a* of second side wall 56. First side 58*c* of top wall 58 is welded to frame 52 and to top end 54*a* of first side wall 54. Second side 58*d* of top wall 58 is welded to frame 52 and to top end 56*a* of second side wall 56.

Back wall 60 extends between the second ends of the first side wall 54 and second side wall 56. Top end 60*a* of back wall 60 is welded to frame and to second end 58*b* of top wall 58. First side 60*c* of back wall 60 is welded to frame 52 and to second side 54*d* of first side wall 54. Second side 60*d* of back wall 60 is welded to frame 52 and to the second side of second side wall 56.

Figure 4:
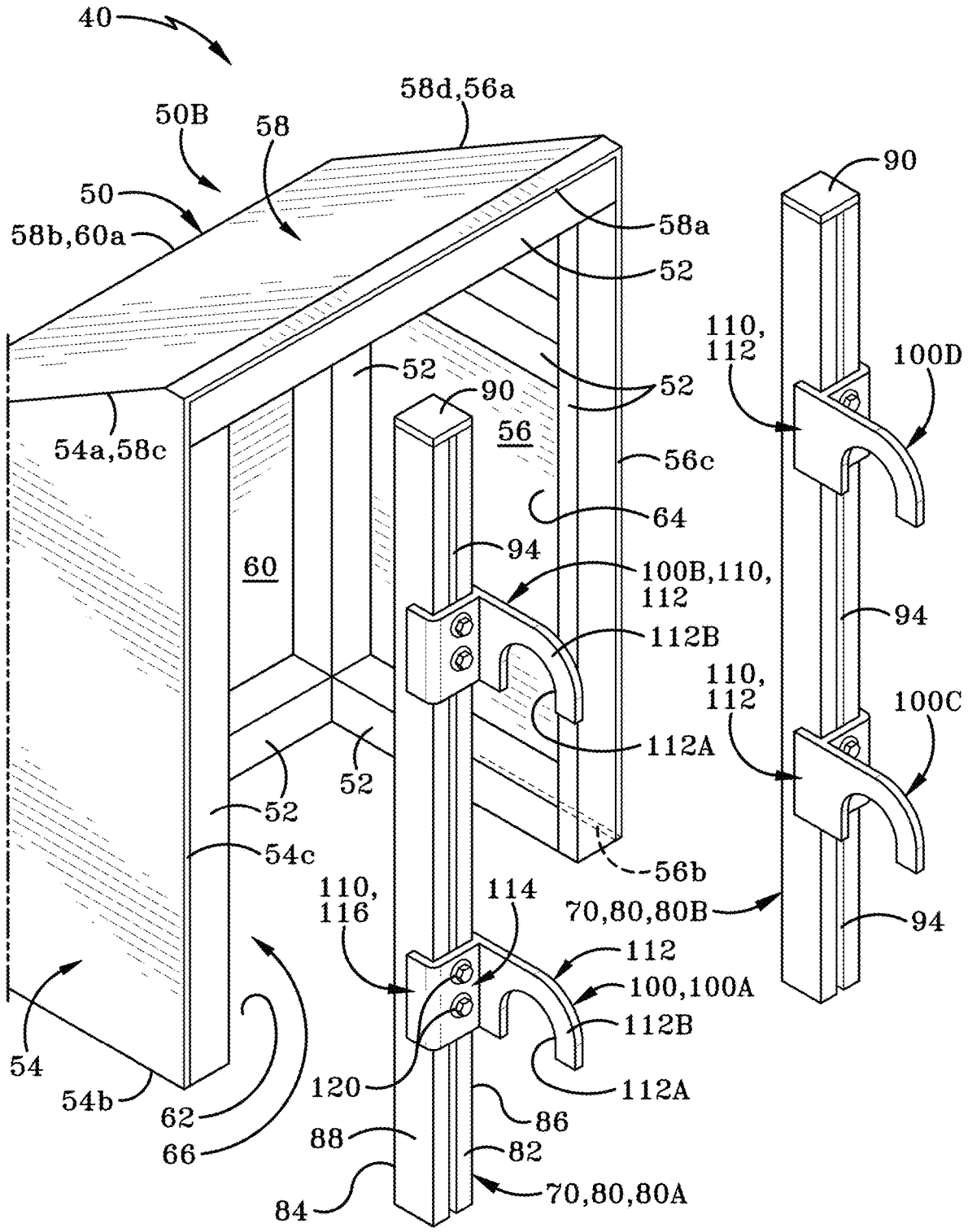
FIG. 4 (FIG. 4) is a partial exploded top, front, left side isometric perspective view of the end cap assembly of FIG. 3, wherein a housing, two attachment bars each having two attachment hooks thereof are shown.

Referring to FIGS. 3 and 4, housing 50 further includes an interior chamber 66 defined and bound by the first side wall 54, the second side wall 56, the top wall 58 and the back wall 60. Housing 50 further comprises a first opening 62 defined between the bottom end 54*b* of the first side wall 54 and a bottom end 56*b* of the second side wall 56. Housing 50 further comprises a second opening 64 defined between a first end 54*c* of the first side wall 54 and a first end 56*c* of the second side wall 56. The first opening 62 and the second opening 64 are in fluid communication with one another and with the interior chamber 66. The interior chamber 66 defined by housing 50 is of a size suitable to receive at least a part of the worker's body "W". The worker is able to enter interior chamber 66 through one or both of first opening 62 and second opening 64.

Referring to FIGS. 3-4, because of the trapezoidal shape of first side wall 54 and second side wall 56, top wall 58 is sloped and is not parallel to bottom ends 54*b*, 60*b*, 56*b* of first side wall 54, back wall 60, and second side wall 56. In particular, the top wall 58 angles downwardly moving in a direction way from a front 50A of the housing 50 towards a back 50B thereof. Because of this slope, the second end 58*b* of top wall 58 is closer to the bottom end 54*a* of the first side wall 54 and to the bottom end 56*a* of the second side wall 56 than is first end 58*a* of top wall 58. The downward and rearward slope of top wall 58 is advantageous because when housing 50 is engaged with spreader bars 26 or 28 of trench box 20, as will be discussed later herein, any loose rocks or other debris falling onto top wall 58 will slide down top wall 58 in a direction moving away from the space 23 (FIG. 2) between the first metal plate 22 and second metal plate 24 of trench box 20.

While top wall 58 has been described above as being sloped, it will be understood that the top wall 58 can be of any configuration with respect to the first side wall 54, the second side wall 56 and the back wall 60 which allows for at least a portion of a body "B" of a worker "W" to be within the interior chamber 66.

In one specific embodiment, top wall 58 is substantially planar and has no curvature thereto. Top wall 58 allows for dirt or debris "D" (FIG. 7) to come to rest on top the top wall 58 and not enter the interior chamber 66 of the housing 50. In another specific embodiment, the surface of the top wall 58 may be of any shape that allows for dirt or debris "D" (FIG. 7) to not enter the interior chamber 66 of the housing 50.

Referring to FIGS. 3-6 and as discussed earlier herein, end cap assembly 40 further includes attachment mechanism 70 which is adapted to detachably engage the housing 50 to one of the sets of spreader bars 26, 28 of trench box 20 Attachment mechanism 70 comprises at least one attachment bar 80 and at least one attachment hook 100. In one specific embodiment, the end cap assembly 40 includes a first attachment bar 80A and a second attachment bar 80B identical in all respects to one another. It should be therefore understood that the following description of the attachment bar 80 applies equally to the first attachment bar 80A and the second attachment bar 80B. It will be further understood that in other embodiments the end cap assembly 40 may comprise any desired number of attachment bars 80.

Figure 6:
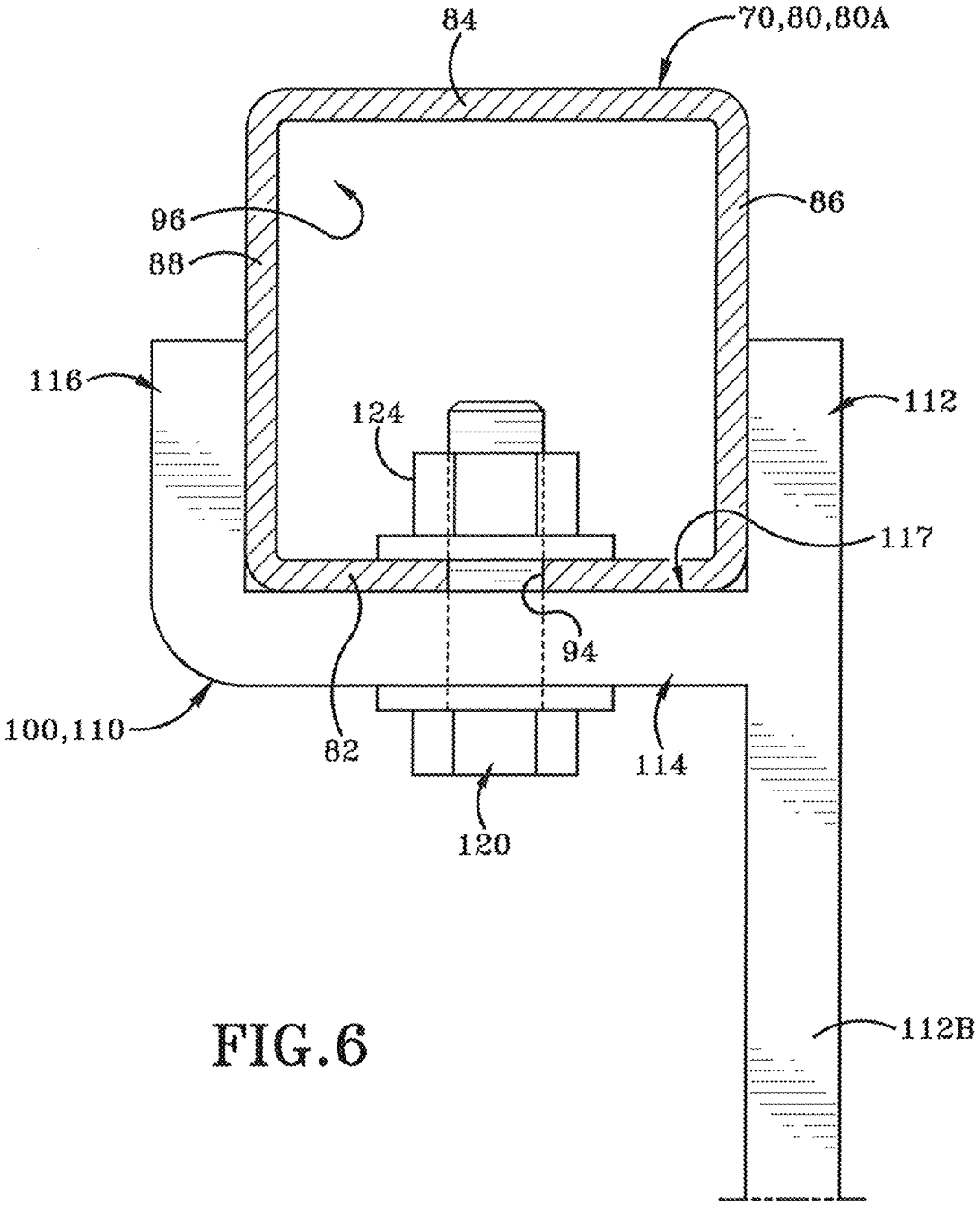
FIG. 6 (FIG. 6) is a cross-section of the attachment bar and the attachment hook of the end cap assembly taken along and looking in the direction of line 6-6 of FIG. 5.

The attachment bar 80 is an elongate member which is secured to one of the frame members of frame 52 of housing 50. As illustrated herein attachment bar 80 is a hollow member which is generally square in cross-section. This is best seen in FIG. 6. Attachment bar 80 comprises a front wall 82 and a back wall 84 opposite to one another. The attachment bar 80 further comprises a first wall 86 and a second wall 88 opposite to one another which extend between and are perpendicular to the front wall 82 and the back wall 84. The attachment bar 80 further comprises a top end 90 and a bottom end 92 opposite to one another and perpendicular to the front wall 82, the back wall 84, the first wall 86, and the second wall 88. The attachment bar 80 defines a channel 94 in front wall 82. Channel 94 is oriented generally parallel to first wall 86 and second wall 88 and extends between top end 90 and bottom end 92. The interior surfaces of front wall 82, back wall 84, first wall 86, and second wall 88 define a hollow interior 96. The channel 94 is in fluid communication with the hollow interior 96 (FIG. 6).

Referring now to FIG. 3, each attachment bar 80A, 80B is secured to the housing 50 of the end cap assembly 40. More specifically, the attachment bar 80A is welded or otherwise secured to frame 52 proximate first end 54*c* of first side wall 54. Attachment bar 80B is welded or otherwise secure to frame 52 proximate first end 56*c* of second side wall 56. In particular, back wall 84 of each attachment bar 80A, 80B is secured to frame 52, and front wall 82 thereof faces outwardly away from frame 52.

Referring to FIGS. 3-6 and as discussed earlier herein, the attachment mechanism 70 includes at least one attachment hook 100. In one specific embodiment, the attachment mechanism 70 includes a first attachment hook 100A and a second attachment hook 100B which are selectively engaged with the first attachment bar 80A; and a third attachment hook 100C and a fourth attachment hook 100D which are selectively engaged with the second attachment bar 80B. It will be further understood that in other embodiments the attachment mechanism 70 may comprise any number of attachment hooks 100.

All of the attachment hooks 100A, 100B, 100C, and 100D are identical to one another. It should be therefore understood that the following description of the attachment hook 100 applies equally to the first attachment hook 100A, the second attachment hook 100B, the third attachment hook 100C, and the fourth attachment hook 100D.

Figure 5:
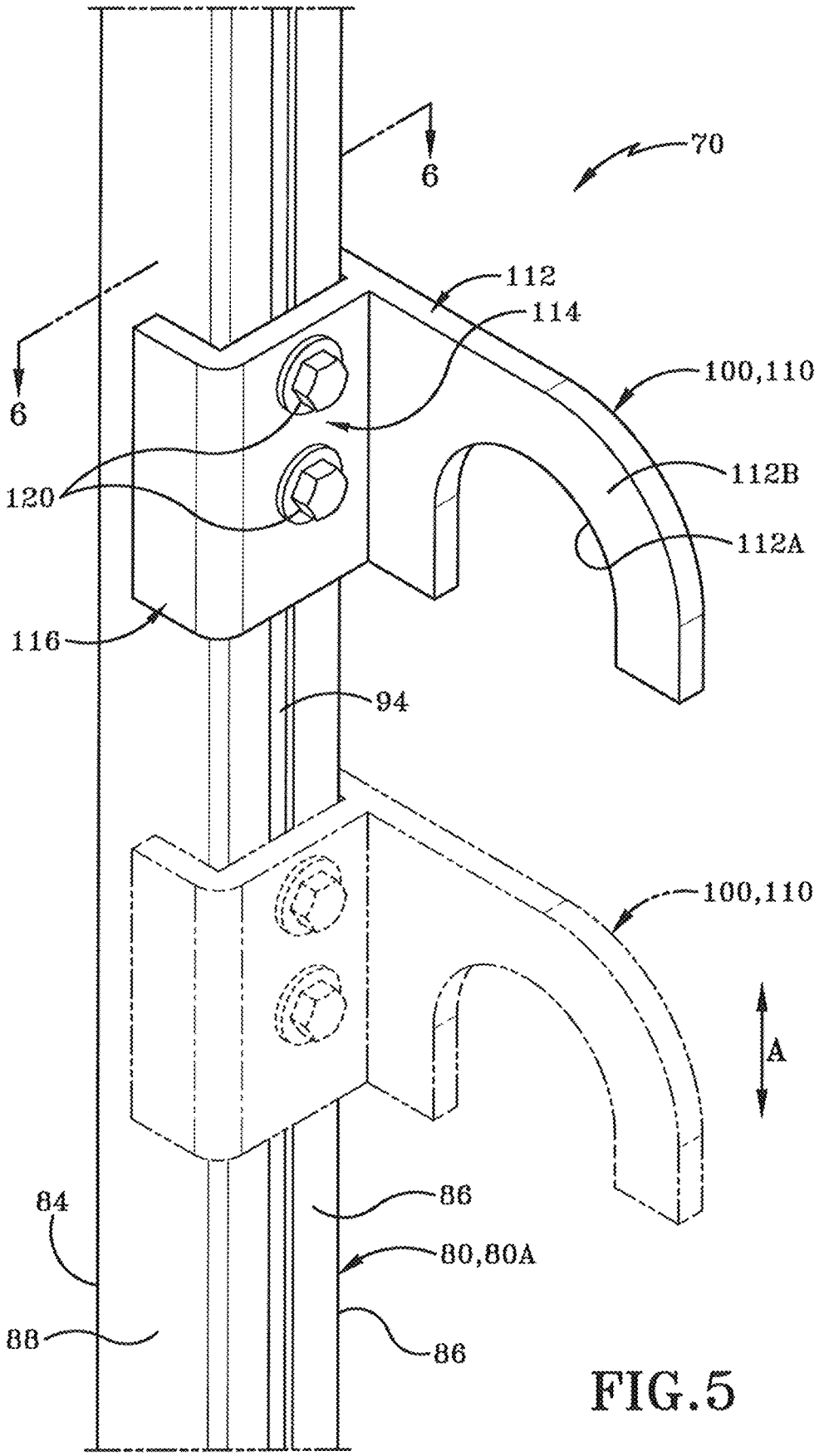
FIG. 5 (FIG. 5) is a partial view of one of the attachment bars and the one of the attachment hooks and showing, in phantom, the attachment hook in an alternative adjusted position.

Referring to FIGS. 5-6, attachment hook 100 comprises a bracket 110 and a hook member 112B integral to and extending outwardly from the bracket 110. Bracket 110 is configured to receive the attachment bar 80. Bracket 110 comprises a first section 112 and a second section 114 continuous with and substantially perpendicular to one another as shown in FIG. 6. Bracket 110 further comprises a third section 116 continuous with and perpendicular to the second section 114 and substantially parallel to the first section 112. A recess 117 is defined between an interior surface of first section 112, an interior surface of second section 114, and an interior surface of third section 116. The recess 117 is configured to receive a portion of the attachment bar 80 therein. When bar 80 is received in recess 117, an interior surface of the first section 112 is adjacent to a portion of the first wall 86 of the attachment bar 80, an interior surface of the second section 114 is adjacent to the front wall 82 of the attachment bar 80, and an interior surface of the third section 116 is adjacent to a portion of the second wall 88 of the attachment bar 80. Bracket 110 is secured to the attachment bar 80 by way of one or more fasteners 120. In one embodiment, the fasteners 120 comprise bolts 120 which are each inserted through an aperture (not shown) defined in second section 114 of bracket 110. The apertures defined in second section 114 are configured to align with channel 94 in attachment bar 80 when attachment bar 80 and bracket 110 are operably engaged with one another. The shaft of fastener 120 is inserted through the aperture in bracket 110, through the channel 94, and a locknut 124 is engaged therewith to secure the fastener 120 in place. The fastener 120 is able to be rotated in a first direction relative to locknut 124 is to loosen fastener 120 so as to allow the position of attachment hook 100 to be adjusted relative to the length of the attachment bar 80 as indicated by arrow "A" (FIG. 5). When attachment hook 100 is at the desired location relative to attachment bar 80, fastener 120 is retightened and thereby locks the attachment hook 100 at the new location on attachment bar 80 (FIG. 5). The ability for the attachment hook 100 to be repositioned along the attachment bar 80 allows for the attachment mechanism 70 to be positioned in various ways to accommodate different spacings of the plurality of spreader bars 26, 28 on the trench box 20.

As illustrated by way of example only, FIG. 3 shows the first attachment hook 100A is secured to the first attachment bar 80A closer to the bottom end 92 thereof than to the top end 90 (FIG. 6). The second attachment hook 100B is secured to the first attachment bar 80A closer to the top end 90 thereof than to the bottom end 92. The third attachment hook 100C is secured to the second attachment bar 80B closer to the bottom end 92 thereof than the top end 90. The fourth attachment hook 100D is secured to the second attachment bar 80B closer to the top end 90 thereof than to the bottom end 92 (FIG. 6). Because the first and third attachment hooks 100A, 100C will be engaged with a same spreader bar 26 or 28, first and third attachment hooks 100A, 100C are laterally aligned with one another and are spaced at a first distance away from the top end 90 of the associated attachment bar 80A, 80B. Similarly, because the second and fourth attachment hooks 100B, 100D are to be engaged with a different spreader bar 26 or 28, second and fourth attachment hooks 100B, 100D are laterally aligned with one another and are spaced a second distance away from the top end 90B of the associated attachment bar 80A, 80B.

It will be understood that instead of the attachment mechanism comprising attachment bars 80A, 80B which are welded or otherwise secured to frame 52 of housing 60, in other embodiments, the attachment bars 80A, 80B may be integral components of the frame 50 and comprise the leading frame members which are welded or otherwise secured to first ends 54*c*, 56*c* of first side wall 54 and second side wall 56, respectively. In this instance, the frame members to which first ends 54*c*, 56*c* are operatively engaged would define a channel suitable to receive fasteners 120 therein.

Referring now to FIGS. 5 and 6, attachment hook 100 will be further described. As is evident when reviewing these two figures, first section 112 of bracket 110 comprises a plate into which an inverted U-shaped hole 112A is defined. The provision of hole 112A causes a leading region of first section 112 to assume a hook shape. The hook shape of first section 112 is indicated by the reference character 112B. The radius of curvature of the U-shaped hole 112A is such that the attachment hook 100 presents a curved surface with is adapted to be complementary to the exterior circumferential shape of one of the spreader bars 26, 28 (FIG. 1).

End cap assembly 40 is removably selectively engageable with the plurality of spreader bars 26, 28 at one end of trench box 20. Specifically, the attachment mechanism 70 of the end cap assembly 40 is removably engaged with the plurality of spreader bars 26, 28. More specifically, the attachment hook 100 of the attachment mechanism 70 is removably engaged with the plurality of spreader bars 26, 28. Even more specifically, the hook member 112B of attachment hook 100 is removably engaged with the plurality of spreader bars 26, 28. Most specifically, the curved surface defined by hole 112A of the hook member 112B receives one of the plurality of spreader bars 26, 28 therein to engage end cap assembly 40 to spreader bars 26, 28.

Before or after installation of trench box 20 into a trench "T", end cap assembly is selectively engaged with the trench box 20. A foreman at the job site will determine whether or not workmen will be performing tasks towards one of a first end or a second end of the trench box 20. The foreman will then determine if there is any risk of debris possibly collapsing into the first or second end of the trench box 20 near where the workers will be working. If so, the foreman will determine that there is need of an end cap assembly 40 to be engaged with the spreader bars 26 near the first end of the trench box 20 and/or if a second end cap assembly 40 needs to be engaged with the spreader bars 28 near the second end of the trench box 20. If it has been determined that an end cap assembly 40 needs to be engaged with the spreader bars 26, then the specific spreader bars for engagement of end cap assembly 40 will be selected and the distance between the selected spreader bars 26 is measured. The fasteners 120 on attachment assembly 70 of end cap assembly 40 are loosened and the brackets 110 of attachment hook 100A, 100B, 100C, and 100D are adjusted relative to attachment bars 80 (as indicated by arrow "A" of FIG. 5) to a distance complementary to the distance between the selected spreader bars 26. When attachment hooks 100A, 100B, 100C, 100D are in the correct locations on attachment bars 80, the fasteners are retightened to lock attachment hooks 100A through 100D in place.

End cap assembly 40 is then oriented in such a way that attachment assembly 70 is proximate spreader bars 26 and the sloped top wall 58 of housing 50 angles downwardly away from spreader bars 26. End cap assembly 40 is then lowered into trench "T" and is guided into engagement with spreader bars 26. End cap assembly 40 is particularly lowered until a first spreader bar 26A (FIGS. 1 and 7) is received within the holes 112B of attachment hooks 100B and 100D and a second spreader bar 26B is received within the holes 112B of attachment hooks 100A and 100C. When this occurs, the entire weight of end cap assembly 40 is borne by first and second spreader bars 26A, 26B, and trench box 20.

Figure 7:
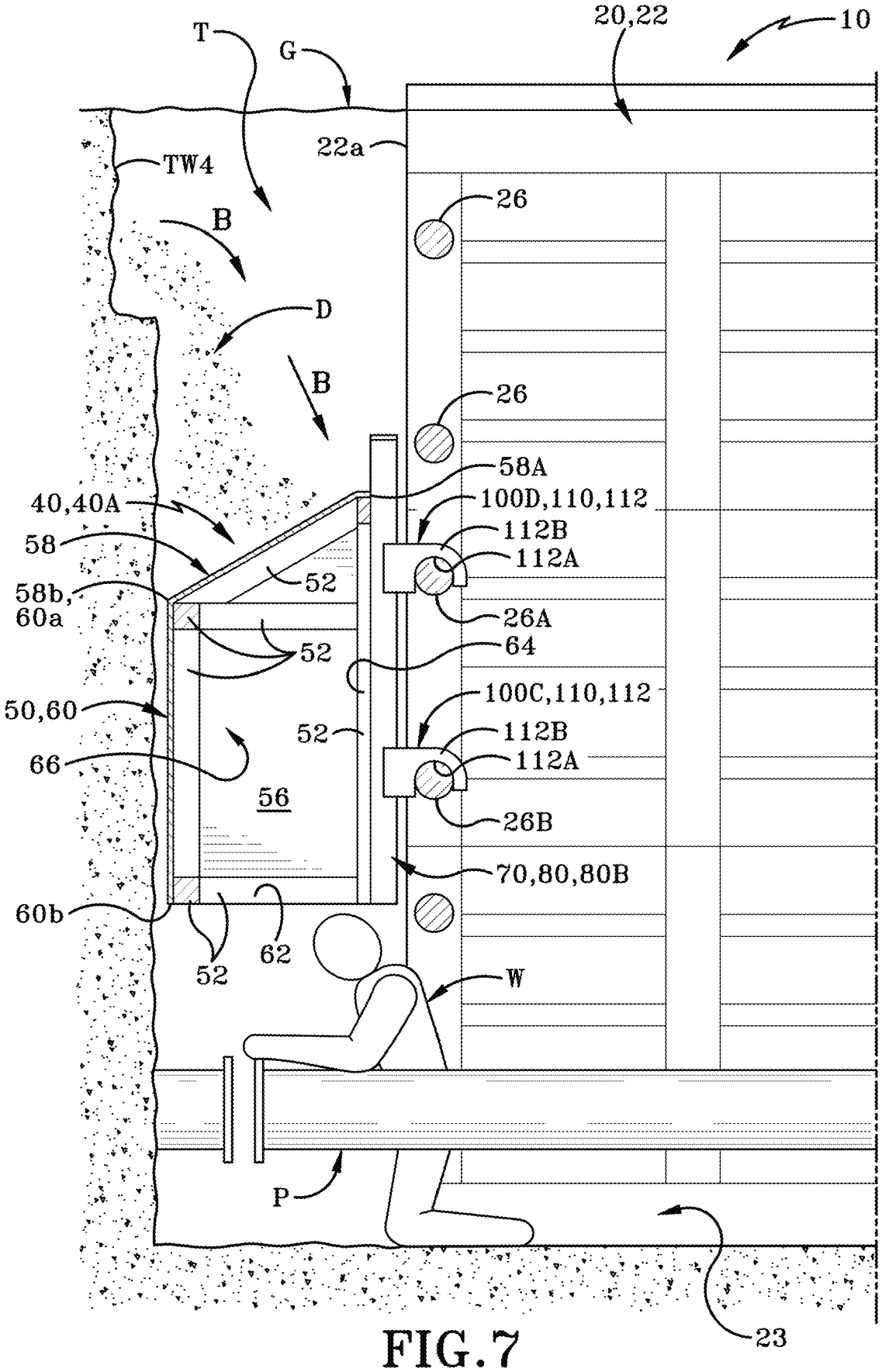
FIG. 7 (FIG. 7) is an operational view of a worker utilizing the trench box assembly within the trench, with some of the ground around the trench box assembly and a portion of the trench box assembly removed for clarity of illustration.

FIG. 7 shows trench box assembly 10 in operation with end cap assembly 40 engaged with spreader bars 26A, 26B and shows a worker "W" who is working on a pipe "P" under the protection provided by end cap assembly 40. In particular, the sloped top wall 58 of end cap assembly 40 protects the worker "W" from debris "D" falling in a direction indicated by arrow "B" into the trench "T". Although not illustrated herein, it will be understood that first side wall 54 protects the worker "W" from debris falling into the trench off trench wall "TW3"; second side wall 56 protects the worker "W" from debris falling into the trench off trench wall "TW1"; and back wall 60 protects the worker "W" from debris falling into the trench off trench wall "TW4". FIG. 7 shows worker "W" on their knees while working. However, should the worker stand up, he or she will be able to safely do so, and their head and torso will be able to enter into the interior chamber 66 bounded and defined by the walls of housing 50.

It will be understood that it is easy to raise or lower end cap assembly 40 relative to the top (or bottom) of the trench, simply by engaging end cap assembly 40 with different spreader bars other than 26A and 26B. FIG. 1 shows a second end cap assembly 40 engaged with spreader bars 28 at the second end of the trench box 20. In each instance, the end cap assembly 40 projects for a distance outwardly beyond the associate end of the first and second metal plates 22, 24 of trench box 20 and into a portion of the trench "T" which is not protected by metal plates adjacent the side walls "TW1", "TW3".

Referring to FIGS. 1, 2, and 7, the present disclosure furthermore relates to a method of protecting a worker in a trench "T" from falling debris "D". The method includes digging the trench "T" in the ground "G" to perform a work operation therein. The method further comprises providing a first metal plate 22 and a second metal plate 24 (FIG. 2) arranged parallel to one another along axis "X1" with the metal plates 22, 24 laterally spaced apart from one another and supporting opposing side walls of the trench, namely walls "TW1" and "TW3". The method includes providing a plurality of spreader bars 26, 28 extending laterally between the first metal plate 22 and the second metal plate 24 to hold the plates a fixed distance apart from one another and to provide a safe workspace 23 for a worker "W" therebetween. The method comprises engaging an end cap assembly 40 with a trench box 20 such that the end cap assembly 40 projects outwardly beyond one end of the trench box 20, wherein the trench box 20 comprises the first metal plate 22, the second metal plate 24 with ends 22*a*, 24*a* and 22*b*, 24*b*. The method further comprises defining an interior chamber 66 (FIG. 7) within the end cap assembly 40. The method even further comprises installing the first metal plate 22, and second metal plate 24, the plurality of spreader bars 26, 28 and the end cap assembly 40 within the trench "T". The method additionally comprises protecting the worker "W" with the end cap assembly 40 where the worker "W" is at least partially covered by one or more walls 54, 56, 58, 60 of the housing 50 of end cap assembly 40 and/or at least partially enters the interior chamber 66 defined by the housing 50 of end cap assembly 40.

In one specific embodiment, the disclosed method may further comprise shielding the worker "W" from debris "D" falling into the trench "T" in the direction "B" (FIG. 7) with the end cap assembly 40 and allowing a worker "W" to enter the interior chamber 66 of the end cap assembly 40 and protecting the worker from the debris "D" falling into the trench "T".

The method further comprises providing a first set of spreader bars 26 extending laterally between a first end region 22*a* of the first metal plate 22 and a first end region 24*a* of the second metal plate 24. The method may further comprise providing a second set of spreader bars 28 extending laterally between a second end region 22*b* of the first metal plate 22 and a second end region 24*b* of the second metal plate 24. The method may comprise engaging a first end cap assembly 40A (FIG. 2) with the first set of spreader bars 26 such that the first end cap assembly 40A protects outwardly beyond the first end region 22*a* of the first metal plate 22 and the first end region 24*a* of the second metal plate 24. The method may further comprise engaging a second end cap assembly 40B with the second set of spreader bars 28 such that the end cap assembly 40B projects outwardly beyond the second end region 22*b* of the first metal plate 22 and the second end region 24*b* of the second metal plate 24.

Figure 8:
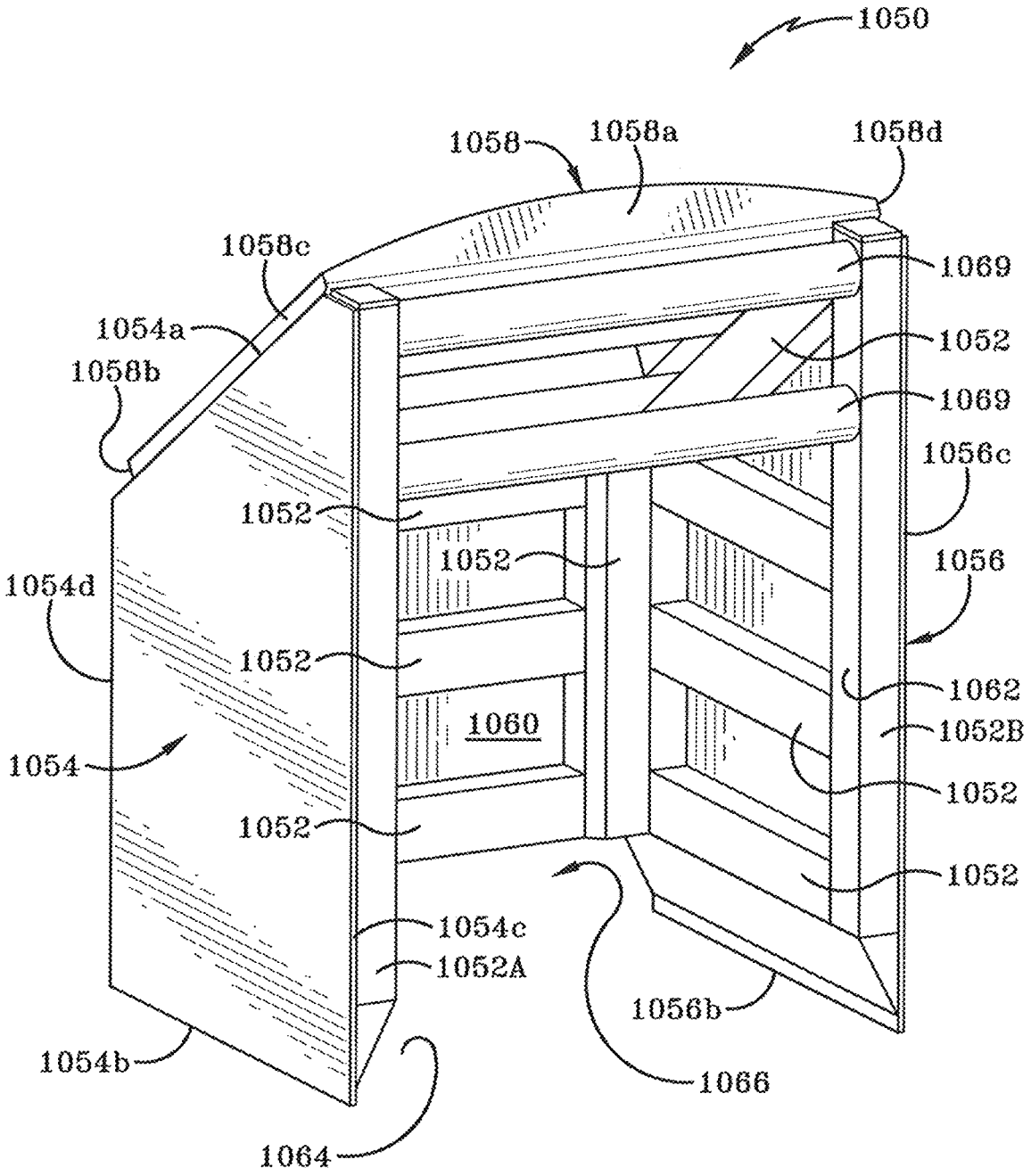
FIG. 8 (FIG. 8) is a top, front, left side isometric perspective view of a second embodiment of an end cap assembly of the trench box assembly according to an aspect of the present disclosure, wherein the second embodiment of the end cap assembly is shown in isolation.
Figure 9:
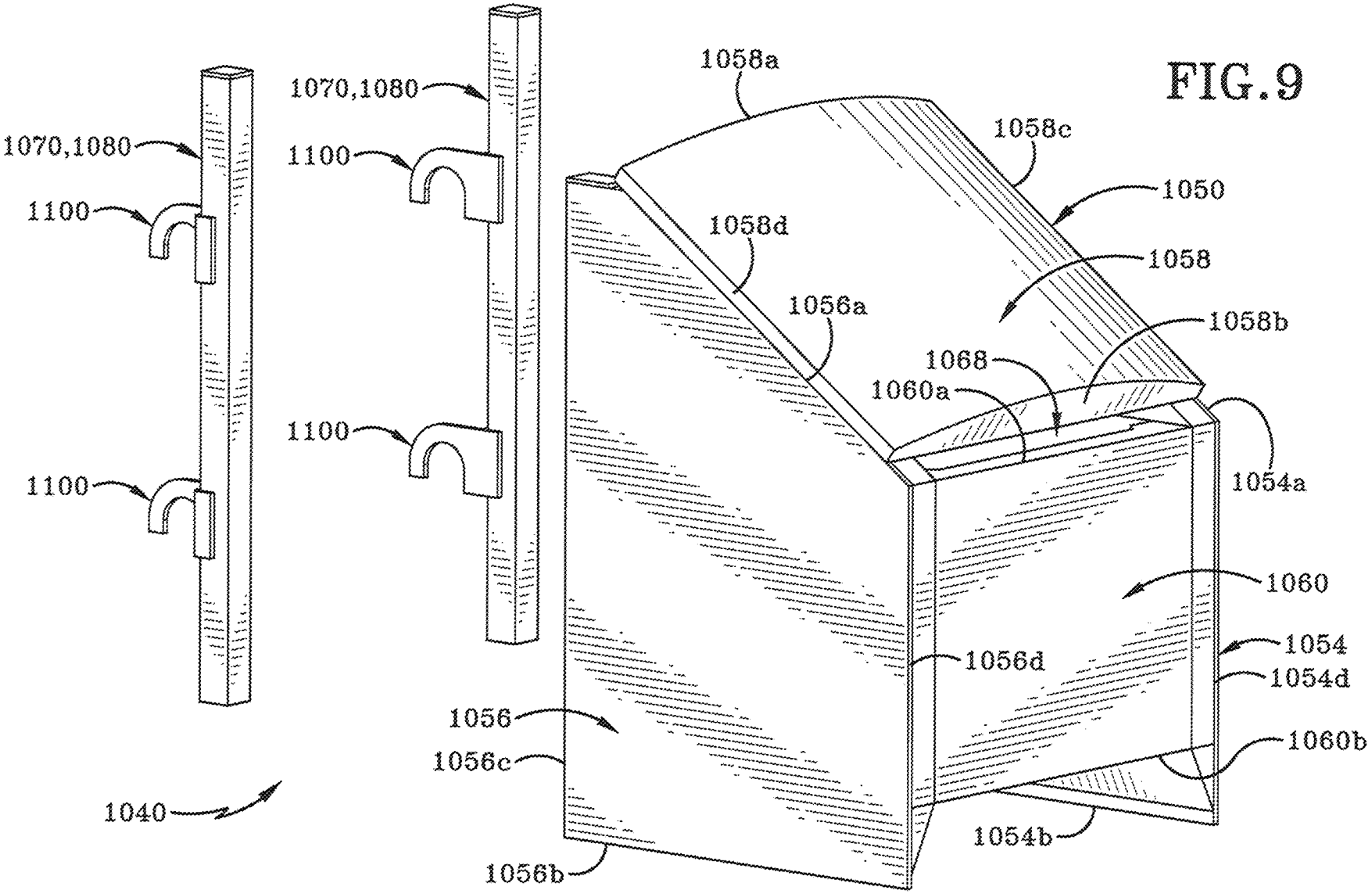
FIG. 9 (FIG. 9) is an exploded top, back, right side isometric perspective view of the second embodiment of an end cap assembly of FIG. 8, wherein a housing, two attachment bars each having two attachment hooks thereof are shown.

Referring now to FIGS. 8 and 9, there is shown a second embodiment of an end cap assembly in accordance with an aspect of the present disclosure, generally indicated at 1040 (FIG. 9). End cap assembly 1040 comprises a housing 1050 and an attachment assembly 1070 (FIG. 9. End cap assembly 1040 is identical in function and structure to end cap assembly 40 except for particular features which will be discussed hereafter.

Housing 1050 comprises a frame 1052, a first side wall 1054, a second side wall 1056, a top wall 1058, and a back wall 1060. The first side wall 1054 and the second side wall 1056 of housing 1050 are arranged parallel to one another and opposite to each other. First side wall 1054 and second side wall 1056 are configured to be substantially identical in structure and function to first side wall 54 and second side wall 56 of end cap assembly 40. Similarly, back wall 1060 is configured to be substantially identical in structure and function to back wall 60 of end cap assembly 40 except that back wall 1060 has a bottom end 1060*b* (FIG. 9) which terminates a short distance vertically upwardly from bottom ends 1054*b* and 1056*b* of first and second side walls 1054 and 1056, respectively. Because first side wall 1054, second side wall 1056 and back wall 1060 are substantially identical to or substantially similar to first side wall 54, second side wall 56 and back wall 60 of end cap assembly 40, first and second side walls 1054, 1056 and back wall 1060 will not be discussed in much detail hereafter.

Housing 1050 differs from housing 50 of end cap assembly 40 with respect to certain features of the frame 1050 and of the top wall 1058. Frame 1050 is used in a substantially identical manner to frame 50, i.e., to serve as a base structure to which the first side wall 1054, second side wall 1056, top wall 1058, and back wall 1060 are fixedly engaged by welding or by use of suitable fastener mechanisms. Frame 1050 differs from frame 50 in that frame 1050 includes one or more support rods 1069 which extend between a first frame member 1052A and a second frame member 1052B. First frame member 1052A is a region of the frame 1052 to which a first end 1054*c* of first side wall 1054 is secured. Second frame member 1052B is a region of frame 1052 to which a first end 1056*c* of second side wall 1056 is secured. The one or more support rods 1069 extend between first frame member 1052A and second frame member 1052B in a location proximate to top wall. Support rods 1069 add structural integrity and strength to frame 1052. First and second frame members 1052A, 1052B and support rods 1069 bound and define a first opening 1062 (FIG. 8) which is in fluid communication with an interior chamber 1066 defined by the frame 1052, first side wall 1054, second side wall 1056, top wall 1058, and back wall 1060. A second opening 1064 to interior chamber 1066 is defined by the lower frame members of frame 1052 and the bottom ends 1054*b*, 1056*b*, of first and second side walls 1054, 1056, and the bottom end 1060*b* (FIG. 9) of back wall 1060.

As with end cap assembly 40, in end cap assembly 1040 an attachment mechanism 1070 is engaged with housing 1050 to enable end cap assembly 1040 to be engaged with spreader bars 26, 28 of a trench box assembly 10. FIG. 9 shows that attachment mechanism 1070 comprises a pair of attachment bars 1080 (FIG. 9) and a plurality of attachment hooks 1100. The attachment mechanism 1070 is identical in structure and function to attachment mechanism 70 and therefore will not be discussed in any further detail herein, other than to indicate that the attachment bars 1080 are secured to first frame member 1052A and second frame member 1052B via welding or any other suitable fastener assembly. As will be evident from the fact that all of the components of end cap assembly are fabricated from metal, the welding or other suitable fastener assembly used to secure attachment mechanism 70 to housing 1050 must be strong enough to enable the entire weight of end cap assembly 40 to be supported by spreader bars 26, 28 and first and second metal plates 22, 24. This holds true for end cap assembly 1040 and end cap assembly 40.

As indicated earlier herein, top wall 1058 of end cap assembly 1040 differs from top wall 58 of end cap assembly 40. The function of top wall 1058 is substantially identical to the function of top wall 58 but the structure of top wall 1058 differs from that of top wall 58. Top wall 1058 has a first end 1058*a*, a second end 1058*b*, a first side 1058*c*, and a second side 1058*d*. When top wall 1058 is viewed from one end and looking towards back wall 1060 as in FIG. 9, top wall 1058 is arcuate in shape. In particular, top wall 1058 is convex in shape with the zenith of the convex shape, i.e., the highest point thereof, being located along a longitudinal midline of the top wall 1058. The longitudinal midline runs parallel to first side 1058*c* and second side 1058*d* and is located midway between first side 1058*c* and second side 1058*d*. The top wall 1058 slopes gently downwardly from the longitudinal midline to each of the first side 1058*c* and the second side 1058*d*. The curvature of top wall 1058 is substantially constant from first end 1058*a* to second end 1058*b* of top wall 1058.

Top wall 1058 is slanted where a second end 1058*b* (FIG. 9) is closer to the bottom end 1054*b* of the first side wall 1054 and the bottom end 1056*b* of the second side wall 1056 than first end 1058*a* (FIG. 9). It should be understood that the top wall 1058 can be of any configuration with respect to the first side wall 1054, the second side wall 1056 and the back wall 1060 where the top wall 1058 allows for a portion of a body "B" of a worker "W" to be within the interior chamber 1066. In addition to being convexly surface, top wall 1058 slopes downwardly moving in a direction away from first end 1058*a* thereof and towards the second end 1058*b* thereof. Like in top wall 58 of end cap assembly 40, the degree of slope imparted to top wall 1058 is dictated by the angle of top ends 1054*a*, 1056*a* of side walls 1054, 1056.

Top wall is suitably secured to frame 1052 to cover the gap between top end 1054*a* of first side wall 1054 and top end 1056*a* (FIG. 9) of second side wall 1056. As shown in FIG. 9, top wall 1058 may not extend all of the distance along the top ends 1054*a*, 1056*a* of first and second side walls 1054, 1056 from first ends 1054*c*, 1056*c* to second ends 1054*d*, 1056*d* thereof, but may, instead originate a short distance inwardly from first ends 1054*c*, 1056*c* and terminate a short distance inwardly from second ends 1054*d*, 1056*d*. A gap 1068 may therefore be defined between second end 1058*b* of top wall 1058 and top end 1060*a* of back wall 1060.

End cap assembly 1040 is secured to spreader bars 26, 28 in a substantially identical manner to how end cap assembly 40 is secured to spreader bars 26, 28. End cap assembly 1040 is secured to spreader bars 26 or 28 so that end cap assembly 1040 projects outwardly for a distance beyond the first end regions 22*a*, 24*a* of metal plates 22, 24 of trench box 20 or projects outwardly for a distance beyond the second end regions 22*b*, 24*b* of metal plates 22, 24 as desired. End cap assembly 1040 will protect a worker "W" (FIG. 7) in a substantially identical manner to end cap assembly 40. The combination of the curvature of top wall 1058 and the slope thereof, may serve to better direct any debris falling on top wall 1058 in a direction away from the safe workspace 23 defined between the metal plates 22, 24 of trench box 20.

In one specific embodiment, a surface of the top wall 58 is concavely curved with respect to the bottom end 1054*b* of the first side wall 1054 and the bottom end 1056*b* of the second side wall 1056. Further in this embodiment, the surface of the top wall 1058 allows for dirt or debris "D" (FIG. 7) to fall off the top wall 1058 and not enter the interior chamber 1066 of the housing 1050. In another specific embodiment, the surface of the top wall 1058 may be of any shape that allows for dirt or debris "D" (FIG. 7) to not enter the interior chamber 1066 of the housing 1050.

A method of protecting a worker "W" in a trench "T" from falling debris "D" (FIG. 7) in accordance with the present disclosure includes digging the trench "T" to perform a work operation therein; providing a trench box assembly 10 including trench box 20 and an end cap assembly 40 or 1040. The trench box 20 comprises a first metal plate 22 and a second metal plate 24 arranged parallel to and laterally spaced apart from one another. The method further includes providing a plurality of spreader bars 26, 28 extending laterally between the first metal plate 22 and the second metal plate 24; engaging the end cap assembly 40 (or 1040) with the spreader bars 26, 28 such that the end cap assembly 40 or 1040 projects outwardly beyond a first end 22*a*, 24*a* of the trench box 20; installing the trench box assembly 10 within the trench "T"; and protecting the worker "W" with the end cap assembly 40 or 1040 when the worker enters an area of the trench "T" below the end cap assembly 40 or 1040

The method may further comprise providing a sloped top wall 58 or 1058 on the end cap assembly 40 or 1040, respectively; angling the sloped top wall 58 or 1058 downwardly away from the plurality of spreader bars 26, 28 and the first end 22*a*, 24*a* of the trench box 20; and causing debris "D" falling on the sloped top wall 58 or 1058 to slide off the sloped top wall in a direction moving away from a safe space 23 defined between the first metal plate 22 and the second metal plate 24 of the trench box 20. The method further comprises defining an interior chamber 66 or 1066 in a housing 50 or 1050 of the end cap assembly 40 or 1040, respectively; and allowing a worker "W" to at least partially enter the interior chamber 66 or 1066; and preventing debris "D" falling onto the housing 50 or 1050 from contacting the worker "W". Providing the plurality of spreader bars may include providing a first set of spreader bars 26 extending laterally between the first metal plate 22 and the second metal plate 24 proximate the first end 22*a*, 24*a* of the trench box 20, and providing a second set of spreader bars 28 extending laterally between the first metal plate 22 and the second metal plate 24 proximate a second end 22*b*, 24*b* of the trench box 20; and wherein the method further comprises engaging the end cap assembly 40, 40A, or 1040 with the first set of spreader bars 26 such that the end cap assembly 40, 40A, or 1040 projects outwardly beyond the first end 22*a*, 24*a* of the trench box 20; and engaging a second end cap assembly 40, 40B, or 1040 with the second set of spreader bars 28 such that the second end cap assembly 40, 40B, or 1040 projects outwardly beyond the second end 22*b*, 24*b* of the trench box 20. Obviously, a worker "W" working proximate the first end 22*a*, 24*a* of trench box 20 will be protected by end cap assembly 40, 40A, or 1040 and a worker "W" working proximate second end 22*b*, 24*b* of trench box 20 will be protected by end cap assembly 40, 40B, or 1040.

It will be further understood that any connections between various components not explicitly described herein may be made through any suitable means including mechanical fasteners, or more permanent attachment means, such as welding or the like. Alternatively, where feasible and/or desirable, various components of the present disclosure may be integrally formed as a single unit.

Unless explicitly stated that a particular shape or configuration of a component is mandatory, any of the elements, components, or structures discussed herein may take the form of any shape. Thus, although the figures depict the various elements, components, or structures of the present disclosure according to one or more exemplary embodiments, it is to be understood that any other geometric configuration of that element, component, or structure is entirely possible.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention.

The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. An end cap assembly to a trench box to protect a worker from falling debris, said end cap assembly comprising:
- a housing of a size suitable to receive a part of a body of the worker therein;
- the housing comprises:
  - a first side wall and a second side wall located opposite one another;
  - a top wall extending between a top end of the first side wall and a top end of the second side wall;
  - a back wall extending downwardly from the top wall and extending between the first side wall and second side wall;
  - wherein the first side wall, the second side wall, the top wall, and the back wall bound and define an interior chamber which is sized to receive the part of the worker's body therein;
- an attachment mechanism operably engaged with the housing; and
- wherein the attachment mechanism is configured to detachably engage the housing to at least one of a plurality of spreader bars of the trench box.

2. The end cap assembly according to claim 1, further comprising a first opening to the interior chamber defined between a first end of the first side wall and a first end of the second side wall.

3. The end cap assembly according to claim 2, further comprising a second opening to the interior chamber defined between a bottom end of the first side wall and a bottom end of the second side wall.

4. The end cap assembly according to claim 1, wherein the top wall of the housing slopes downwardly and rearwardly towards a top end of the back wall.

5. The end cap assembly according to claim 4, wherein the top wall is convex in shape.

6. The end cap assembly according to claim 1, wherein the attachment mechanism comprises:
- an attachment hook extending outwardly from the housing; and
- wherein the attachment hook is configured to detachably engage the at least one of the plurality of spreader bars of the trench box.

7. The end cap assembly according to claim 6, wherein the attachment hook is adjustably engaged with the housing.

8. The end cap assembly according to claim 7, wherein the attachment mechanism further comprises:
- a channel defined in the attachment mechanism; and
- a fastener extending through a portion of the attachment hook and into the channel; wherein the fastener is selectively movable along the channel to adjust a position of the attachment hook relative to the housing.

9. A trench box assembly for protecting a worker from falling debris, said trench box assembly comprising:
- a trench box having a first end and a second end, said trench box comprising:
  - a first metal plate and a second metal plate arranged parallel to one another and laterally spaced apart from one another;
  - a plurality of spreaders bars extending between the first metal plate and the second metal plate;
- an end cap assembly detachably operatively engaged with the plurality of spreader bars of the trench box such that the end cap assembly extends outwardly beyond the first end of the trench box; and
- wherein the end cap assembly includes a top wall and wherein the top wall is configured to prevent debris from falling onto the worker working below the top wall.

10. The trench box assembly according to claim 9, wherein the end cap assembly comprises:
- a housing defining an interior chamber of a size suitable to receive at least part of a body of the worker therein;
- an attachment mechanism operably engaged with the housing; and
- wherein the attachment mechanism is configured to detachably engage the end cap assembly with at least one of the plurality of spreader bars of the trench box.

11. The trench box assembly according to claim 10, wherein the housing comprises:
- a first side wall and a second side wall located opposite one another;
- the top wall extending between a top end of the first side wall and a top end of the second side wall;
- a back wall extending downwardly from the top wall and extending between the first side wall and second side wall; and wherein the first side wall, the second side wall, the top wall, and the back wall bound and define the interior chamber which is sized to receive the part of the worker's body therein.

12. The trench box assembly according to claim 10, wherein the attachment mechanism comprises:

an attachment hook extending outwardly from the housing; and wherein the attachment hook is configured to detachably engage the at least one of the plurality of spreader bars of the trench box.

13. The trench box assembly according to claim 12, wherein the attachment hook is adjustably engaged with the housing.

14. The trench box assembly according to claim 13, wherein the attachment mechanism further comprises:

a channel defined in the attachment mechanism; and a fastener extending through a portion of the attachment hook and into the channel; wherein the fastener is selectively movable along the channel to adjust a position of the attachment hook relative to the housing.

15. A method of protecting a worker in a trench from falling debris, wherein the method comprises:

digging the trench to perform a work operation therein;

providing a trench box including a first metal plate and a second metal plate arranged parallel to and laterally spaced apart from one another;

providing a plurality of spreader bars extending laterally between the first metal plate and the second metal plate;

engaging an end cap assembly with the trench box such that the end cap assembly projects outwardly beyond a first end of the trench box;

providing a sloped top wall on the end cap assembly;

angling the sloped top wall downwardly away from the plurality of spreader bars and the first end of the trench box;

installing the trench box within the trench;

causing debris falling on the sloped top wall to slide off the sloped top wall in a direction moving away from a safe space defined between the first metal plate and the second metal plate of the trench box; and protecting the worker within the end cap assembly when the worker enters an area of the trench below the end cap assembly.

16. The method according to claim 15, further comprising:

defining an interior chamber in a housing of the end cap assembly;

allowing the worker to at least partially enter the interior chamber; and preventing debris falling onto the housing from contacting the worker.

17. The method according to claim 15, wherein providing the plurality of spreader bars includes providing a first set of spreader bars extending laterally between the first metal plate and the second metal plate proximate the first end of the trench box, and providing a second set of spreader bars extending laterally between the first metal plate and the second metal plate proximate a second end of the trench box; wherein the method further comprises:

engaging the end cap assembly with the first set of spreader bars such that the end cap assembly projects outwardly beyond the first end of the trench box; and engaging a second end cap assembly with the second set of spreader bars such that the second end cap assembly projects outwardly beyond the second end of the trench box.

* * * * *